United States Patent [19]

Shepherd

[11] 4,212,174

[45] Jul. 15, 1980

[54] LAY-IN YARN FEED

[76] Inventor: Michael W. Shepherd, 29 Park Rd., Cross Hills, Near Keighley, Yorkshire, England

[21] Appl. No.: 824,176

[22] Filed: Aug. 12, 1977

[30] Foreign Application Priority Data

Aug. 25, 1976 [GB] United Kingdom ..... 35280/76

[51] Int. Cl.[2] ..... D04B 9/16

[52] U.S. Cl. ..... 66/9 R; 66/141

[58] Field of Search ..... 66/9 R, 13, 125 R, 131, 66/141, 190, 64, 19, 200, 60, 126 A; 242/157 R; 139/450

[56] References Cited

U.S. PATENT DOCUMENTS

| | | | |
|---|---|---|---|
| 2,702,463 | 2/1955 | Carter | 66/9 R |
| 2,775,109 | 12/1956 | Scarborough | 66/126 A |
| 3,529,442 | 9/1970 | Gelber et al. | 66/9 R |
| 3,556,165 | 1/1971 | Zmatlik et al. | 66/190 X |
| 3,613,401 | 10/1971 | Jeffcoat et al. | 66/60 |
| 3,884,053 | 5/1975 | Niederer | 66/190 X |
| 3,943,733 | 3/1976 | Wily | 66/9 R X |
| 3,961,498 | 6/1976 | Braunschweiler | 66/13 |
| 4,080,808 | 3/1978 | Laurent | 66/125 R |

FOREIGN PATENT DOCUMENTS

| | | | |
|---|---|---|---|
| 920834 | 2/1973 | Canada | 66/9 R |
| 2559544 | 4/1977 | Fed. Rep. of Germany | 66/126 A |
| 67529 | 6/1969 | German Democratic Rep. | 66/9 R |
| 636963 | 5/1950 | United Kingdom . | |
| 167941 | 3/1965 | U.S.S.R. | 66/9 R |

*Primary Examiner*—Werner H. Schroeder
*Assistant Examiner*—Andrew M. Falik
*Attorney, Agent, or Firm*—Norris & Bateman

[57] ABSTRACT

The invention relates to circular weft knitting and according to the method described, those stitches which are formed between a cylinder needle and a dial needle are formed around a guide member which lies in the angle between the verges of the cylinder and the dial, these stitches sliding off one end of the guide member. The guide member lies in at least that region of the machine where the needles begin to lift, and preferably extends beyond the position at which the needles slip the loops so that the stitches formed between the cylinder needles and the dial needles are completely formed over the guide member.

The invention is particularly useful for controlling the insertion of a lay-in effect yarn, since the guide member provides a containing effect which restricts movement of the lay-in yarn out of the mouth between the stitches already formed on the cylinder needles, and those about to be formed on the dial needles. It is possible to use lay-in yarns of large diameter.

The invention includes a guide member having a circumscribing yarn guide and an axially extending guide finger, and further the invention includes a circular knitting machine fitted with such a yarn guide.

6 Claims, 7 Drawing Figures

LAY-IN YARN FEED

Figure 1:
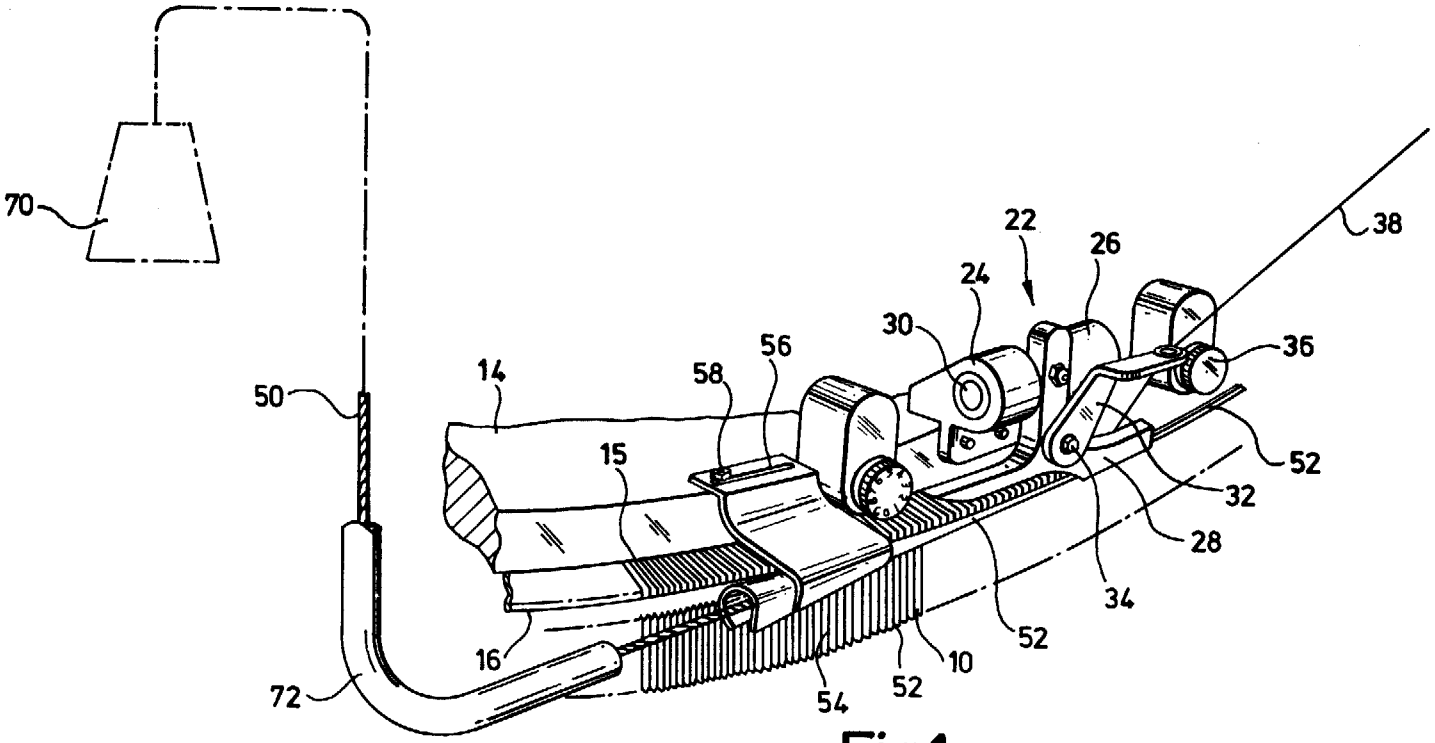

This invention relates to circular weft knitting, and in its broadest aspect, it provides a method of knitting wherein there is a greater control over the formation of the stitches, than there is with conventional weft knitting. The purpose of exercising this improved control over the stitch formation is to reduce the incidence of stoppages and spoiled fabric due to loops slipping off the needles.

According to this aspect of the invention in the production of a fabric on a circular knitting machine, those stitches which are formed between a cylinder needle and a dial needle are formed around a guide member which lies in the angle between the verges of a cylinder and the dial, these stitches sliding off one end of the guide member. In conventional weft knitting, at any position where a stitch is to be formed by a cylinder needle and a co-operating dial needle, the yarn is looped around both needles and when the dial needle is advanced and the cylinder needle is lifted, and drawns the new yarn through the loop on itself to form a stitch, which stands out from the "ground" stitches formed only on the cylinder needles. In this way a rib is formed along a wale of the fabric corresponding to each operative dial needle. However, the loop can strip off the cylinder needle during the formation of this rib stitch because the stitch is relatively loose during its formation. By forming the stitch around the guide member, the loop is kept taut and there is less chance of the loop slipping off the needle.

It is possible to lay an effect yarn - usually referred to as a lay-in yarn - in the open "mouth" formed between the two sets of loops, one on the cylinder needles and the other on the dial needles, this lay-in yarn being secured in the fabric by the next course of stitches as they are formed between the cylinder needles and the dial needles over the lay-in yarn. The "mouth" between the two sets of stitches is to the rear of the cylinder needles when the latter are lifted and under the dial needles when the latter are advanced, so that the lay-in yarn has to be positioned in the effective "tunnel" formed at the verges of the fabric by the two sets of stitches and the backs and undersides of the needles themselves. The lay-in yarn is usually fed through a guide tube, the outlet end of which is positioned as close as possible to the "mouth" of the stitches at the leading end of a yarn feeder on the macine, i.e. immediately in front of the position at which the needles begin to rise.

One of the problems associated with this method of producing an effect fabric is that a cylinder needle might push the lay-in yarn to its front side, or a dial needle might push the lay-in yarn to its top side. That results in spoiled fabric, and it can also damage the needles themselves. The problem becomes more acute as the diameter of the lay-in yarn increases, and it will be appreciated that with a lay-in yarn above a certain "counts" damage to the needle is almost sure to occur if the lay-in yarn is displaced to the wrong side of one of the needles and then caught in the needle hook. There is therefore a practical limit to the size of yarn which can be used as the lay-in yarn, and this severely estricts the type of effect which can be obtained by such yarns. Furthermore, with the known methods and apparatus, one never completely obviates the danger of the lay-in yarn being displaced during the knitting process.

According to another aspect of the invention, in the production of a fabric on a circular knitting machine, a lay-in yarn is fed into the "mouth" between two sets of stitches at the leading side of a feeder, so that it is trapped between the course of stitches on which it is laid and the next stitches formed between the cylinder and dial needles, the lay-in yarn passing under and being subject to the containing effect of a guide member which restricts movement of the lay-in yarn out of the said "mouth", at least in the region where the needles begin to lift. It will be appreciated that if the lay-in yarn is thus contained at the position of lift of the needles, it is practically impossible for the lay-in yarn to be pushed to the wrong side of the needles. Furthermore it is possible to distend the "mouth" inwardly to accommodate a bulky lay-in yarn.

Preferably the containing effect is continued through the feed station to a position adjacent to the position at which the needles slip the loops, and in the preferred method of operation, the containing effect is continued to a position after that at which the needles slip the loops, so that the said next stitches are completely formed over the guide member.

According to a further aspect of the invention a guide member for use in a circular knitting machine in either of the methods of the first two aspects of the invention has a circumscribing yarn guide which at an inlet end provides a wall subtending approximately a full circle, but which subtends a decreasing angle towards it outlet end, where it merges into an axially extended guide finger, the yarn guide being open throughout its length at one side, so that a yarn can be placed in it through the side opening without the necessity for threading through guide. Preferably a resilient plate closes the side opening of the guide, the resilience of the plate permitting it to be displaced to allow a yarn to enter the guide.

The finger of the guide member may be concave in cross-section on the inside, so that it is adapted to closely embrace a lay-in yarn.

The finger may also be arcuate along its length so that it is adapted to conform to the curvature of the cylinder of the knitting machine. Preferably the circumscribing yarn guide lies at an angle to the finger so that the inlet end of this part is displaced radially outwards from the outlet (finger) end, having regard to the eventual orientation of the guide in the machine.

According to yet another aspect of the invention a circular knitting machine having both cylinder needles and dial needles is provided with a guide member which has a finger portion extending in the angle between the verges of the cylinder and the dial, the finger extending over at least the position where the cylinder needles begin to lift at the leading end of a yarn feeder.

Preferably the finger of the guide member extends from a position in advance of that at which the cylinder needles begin to lift to the rear of the position at which the needles slip the loops, so that the finger is effective to control the stitches throughout the zone wherein the needles are lifted. The finger portion of the guide member is preferably disposed behind the cylinder needles (when the latter are lifted) and below the dial needles (when the latter are advanced).

It is preferred that the guide member is constructed as previously described, and it is preferably mounted cantilever fashion from a stationary part of the machine, the circumscribing part being attached to the mounting means and the finger extending therefrom and being free at the end remote from the circumscribing part. The mounting means preferably provide for circumferential adjustment of the guide member on the machine.

Figure 2:
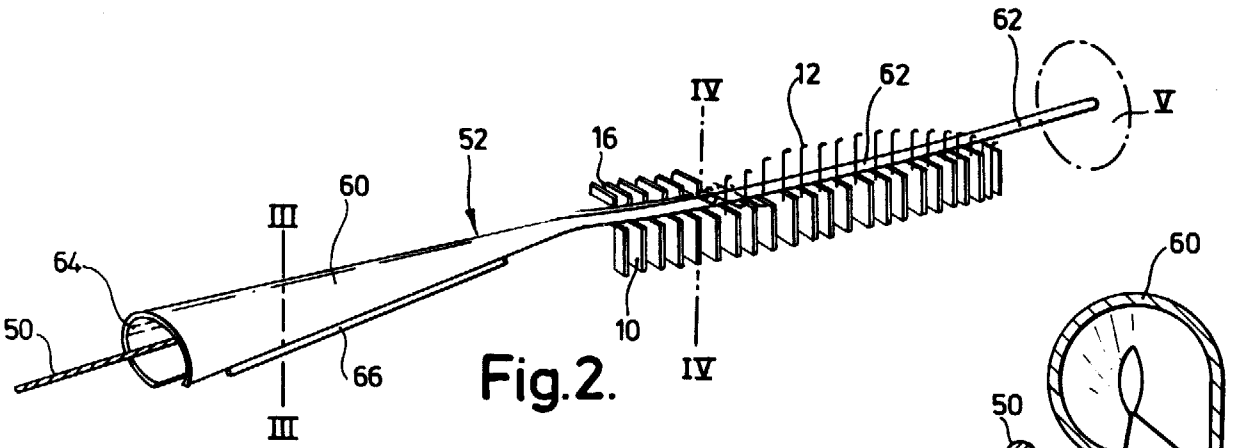
Figure 3:
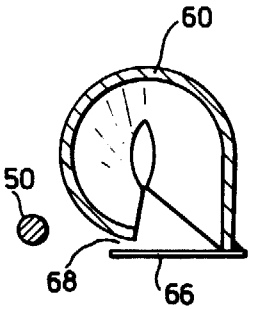
Figure 4:
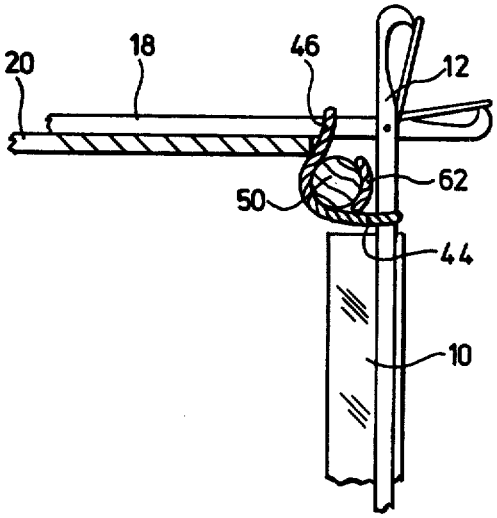
Figure 5:
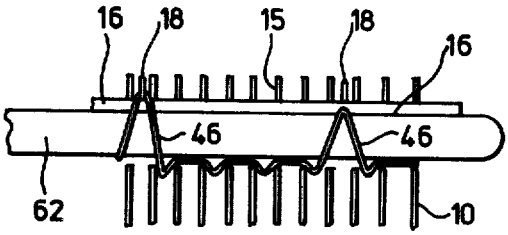
Figure 6:
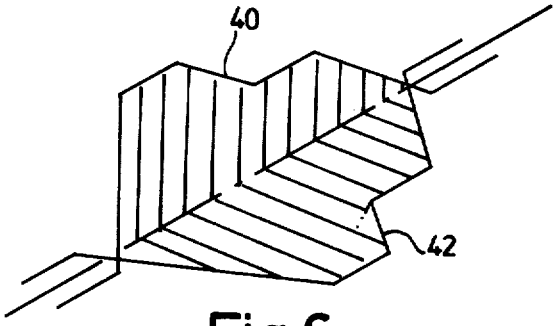
Figure 7:
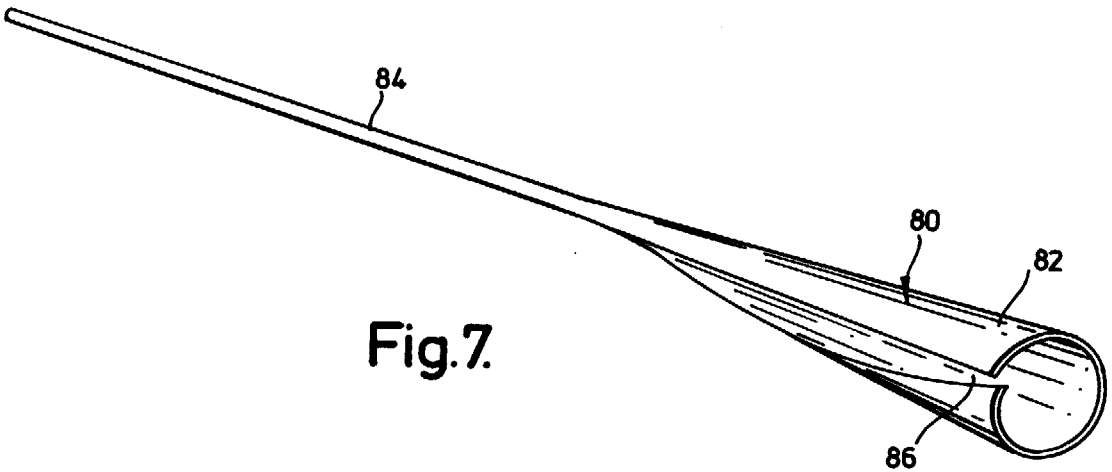

The modification of a circular weft knitting machine, a guide member for use on the machine and a method of operating the modified machine will now be described by way of examples of different aspects of the invention, with reference to the accompanying drawings, in which:

FIG. 1 is a perspective view of a single feeder station in a circular knitting machire, FIG. 2 is a perspective view of a guide member, FIG. 3 is a section to an enlarged scale on the line III—III in FIG. 2, FIG. 4 is a section to an enlarged scale on the line IV—IV in FIG. 2, FIG. 5 is an enlarged elevation of the part of the guide member shown a V in FIG. 2, FIG. 6 is a three dimensional graph showing the movement of the needles, and FIG. 7 is a perspective view of an alternative form of yarn guide member.

The invention is here illustrated as applied to a double knitting circular knitting machine set up to knit a "ground" fabric with spaced apart "ribs" on one face of the "ground". It is not necessary to describe the knitting machine itself, since apart from the modifications hereinafter described, it is of known construction. For present purposes it will be mentioned that the machine has the usual cylinder (some of the cylinder tricks are shown at 10) within which slide the cylinder needles (some of which are visible at 12 in FIG. 2) and the usual dial, the dial cam box being shown at 14, the dial tricks at 15, a dial needle at 18, and the dial plate at 20 - see FIG. 4.

Also the machine has the usual series of yarn feeders arranged at angularly spaced positions, one of which is indicated generally at 22 in FIG. 1. Each feeder 22 comprises a pair of mounting brackets 24 and 26 secured to the periphery of the dial cam box 14, with a carrier 28 pivoted on a shaft 30 mounted in the brackets, so that the carrier can occupy the operative position shown in FIG. 1, or can be swung upwardly about the shaft 30 to permit access to the dial needles. A yarn guide 32 is pivoted at 34 on the carrier 28 and has a pot eye 36 through which the yarn 38 required to form the knitting fabric is fed. Since there is a series of feeders 22 around the machine, a corresponding number of yarns are fed to the needles. In the present instance, most of these yarns are fed only to the cylinder needles, which are arranged to knit the "ground" of the fabric, but the particular yarn 38 shown in FIG. 1 is fed also to the dial needles, the two sets of needles co-operating to produce the rib stitches on the "rear" of the fabric.

As the cylinder needles 12 traverse past the feeders, they are lifted and lowered by cams (not shown), to form the stitches. The path of the cylinder needles 12 as they pass the feeder station 22 is shown by the line 40 in FIG. 6. Similarly as the dial needles pass the feeder 22, they are acted on by cams (not shown) so that dial needles at spaced apart positions - corresponding to the number of "ground" stitches between "ribs" - are forced to follow a path shown by the line 42 in FIG. 6 - it being understood that the cylinder needles 12 move in a vertical plane, whereas the dial needles 18 move in a horizontal plane.

The machine is set so that it knits "face-inside" as the needles pass through the feeder station - from left to right as seen in FIGS. 1 and 2 - the cylinder needles 12 produce loops 44 (see FIG. 4) on the inside, whereas the dial needles 18 produce loops 46 which in the finished fabric are on the outside (see FIG. 4 and 5) this being characteristic of double knitting on a circular weft knitting machine. Where the new loops are extending from the needles to the body of the knitted fabric, the two sets of loops produce in effect an open "mouth" 48 between the inside loops and the outside loops.

Now if a fancy effect or lay-in yarn such as that illustrated at 50 in FIG. 1, is to be put into the fabric, it is possible to lay it in the open "mouth" 48 between the two sets of loops, so that as the succeeding sets of loops 46 is formed, the effect yarn 50 is trapped between the two suceeding courses of stitches. It is to be understood that the lay-in effect yarn 50 is not in itself knitted into the fabric, since it is nowhere looped into itself or into other yarns, but it simply lies in the tight "tube" formed between two adjacent courses of stitches.

In the known method of providing a lay-in yarn effect, that yarn is fed through a tube the outlet end of which is positioned close to the open "mouth" 48 at the rear of the cylinder needles and below the dial needles. Since the lay-in yarn leaves the feed tube at the leading end of the feeder station 22 (i.e. at a position just before that at which the needles begin to lift) there is a considerable length of lay-in yarn from this position to the other end of the feeder station where the loops cross and the lay-in yarn is trapped by the next course of stitches, and this length of yarn is virtually uncontrolled. Hence, there arises the danger of a cylinder needle, as it is rising, passing on the wrong side of the lay-in yarn. Furthermore, for practical reasons, it is desirable to keep the distance between the verges of the cylinder and the periphery of the dial plate as small as possible, and this limits the size of the "mouth" 48, and hence limits the size of the lay-in yarn.

For the purpose of the present invention the dial plate 20 is raised to provide a larger "mouth" 48 than would normally be considered prudent. For example, this gap may be 4 millimeters wide. Also, a mounting for a cheese 70 of the lay-in yarn 50, is provided in any convient position near to the feeder station 22, and a guide tube 72 is fastened to the machine in the vicinity of the feeder station to guide yarn drawn off the cheese 70 towards the feeder station. It will be appreciated that the cheese 70 has only been illustrated diagrammatically in FIG. 1. In practice, it may be located near to floor level or on creel above the knitting machine. It will also be appreciated that there may be a stop motion and a yarn clearer between the cheese 70 and the tube 72.

The machine is also provided with a lay-in yarn guide member 52 which at its leading end is secured by a bracket 54 dto the dial cam box 14. An elongate slot 56 is formed in the bracket 54 to receive a fixing screw 58, and hence it is possible to adjust the circumferential position of the guide member 52 within limits determined by the length of the slot 56. The guide member 52 forms an important feature of the invention, and will therefore be described in detail. It is made of thin wear resisting material, such as case hardened steel, and is given the special formation illustrated, so that it has a guide portion 60 and a finger 62.

The guide portion tapers from a wide entering end at 64 to a narrow leaving end and is in the form of a scroll subtending almost a full circle about a longitudinal axis, but open on the underside. In fact, the angle subtended by the scroll is gradually reduced away from the entering end 64 until it merges with the finger 62, which is a long narrow element of slightly arcuate cross-section with the concave side at the rear.

A spring steel plate 66 is soldered to the guide portion at the outside of the opening, and this plate extends across the opening, leaving a narrow gap 68 between thee scroll and the plate 66 along the inside of the guide portion. It is possible to thread up the guide member 52, by pressing the yarn 50 through this gap 68, the plate 66 yielding to allow the yarn to pass through the gap, but closing again behind the yarn. Once the yarn has been thus threaded into the guide member, it is almost impossible for the yarn to escape from the guide member.

The finger 62 is longer than the guide portion 60, and is curved as seen from above, so that it conforms to the curvature of the verges and the periphery of the dial plate 20. Although the finger is only about 3 millimeters deep, it occupies most of the depth between the dial plate 20 and the verges of the cylinder tricks 10 (see FIG. 4). It is however located near to the inside of the verges so that it is on the inside of any raised cylinder needles, and of course, it lies below any projected dial needles - such as the needles 18 shown in FIG. 4. The guide portion 60 is straight but angled outwardly from the finger portion, so that its entering end 64 is displaced outwardly from the cylinder, so that it is aligned with the outlet end of the guide tube 72.

In use, a starting length of fabric is knitted on the machine using only the yarns 38. The machine is then stopped and the lay-in yarn 50 is then drawn off the cheese 70, threaded through the guide tube 72 and then pulled into the guide portion 60 of the guide member 52. The leading end of this lay-in yarn is then taken along and beyond the rear of the finger 62 which holds it pressed against the loops 44 and 46. In fact, if the lay-in yarn is of large diameter, the loops 44 and 46 will be distended inwardly by the lay-in yarn.

As the needles pass the yarn guide member 52, the cylinder needles rise and fall as previously described and the selected dial needles are projected to knit the rib stitches. As soon as a rib stitch is formed on the part of the lay-in yarn 50 lying beyond the finger 62, that stitch grips the lay-in yarn and begins to pull it with the knitted fabric around the cylinder.

The guide portion 60 functions in much the same manner as the known lay-in yarn guide tube, in that it directs the effect yarn 50 to the position previously described to the rear of the cylinder needles 12 and on the underside of the dial needles 18, and in the "mouth" 48 of the fabric. The finger 62 on the other hand, exercises a completely new control function in relation to the lay-in yarn 50. Because of its small cross-section, the finger 62 is able to extend through the "tunnel" defined by the "mouth" 48 of the fabric and the two sets of needles. (The cylinder needles 18 may rub on the outer face of the finger when they are lifted above the verges of the cylinder). Thus, the lay-in yarn enters the guide member at the larger inlet end 64 of the eye portion and exits therefrom substantially at the mouth 48, and is then controlled by the finger 62. Thus, the finger lies closely adjacent to the path of the lay-in yarn 50 in the region where in the known method, that yarn would have been uncontrolled. Indeed, it will normally be possible to ensure that the finger 62 presses quite firmly on to the yarn 50 in this region. Moreover, the finger 62 extends beyond the position (indicated at the righthand end of FIG. 5) where the dial needles have been retracted out of the old loops, and therefore the loops are crossed - or, to put it another way, the "mouth" 48 is closed - on to the trailing end of the finger 62. Because of the cantilever mounting of the finger from the bracket 54, the loops will easily slide off the finger with the lay-in yarn 50 trapped in and travelling with thefabric.

Now it will be apparent that the yarn 50 is closely controlled by the finger 62 and consequently there is very little danger of the yarn being diverted to the wrong side of any of the needles. Clearly this makes for smoother working of the machine, and in this respect, the close control of the lay-in yarn also ensures that the yarn is laid evenly in the knitted fabric. There is however another very important advantage; since the danger of displacement into the hooks of the needles has been virtually eliminated, it is possible to use quite thick lay-in yarn and yarns as thick as Nm 1.1 metric count have been used. This opens up the possibility of producing new fabric effects suitable for use as dress fabrics, curtains and wall coverings. Moreover, it is possible to use specially formed lay-in yarns such as nep yarns or yarns with permanent loops. It is also possible to produce a pile on a fabric having such a lay-in yarn, particularly if there are loops in that yarn, by teasing or brushing to draw out the individual fibres of the effect yarn. Tests have shown that with a lay-in yarn of 1.1's count having permanent loops, it is possible to draw out a pile of 1 to 2 inches in length, so that there is opened up the prospect of knitting carpets or other pile fabrics.

It is to be understood that the guide member 52 can be used even when fabric is being knitted which does not include a lay-in yarn. In that case, the cheese 70 will not be provided and the guide tube 72 will be redundant. Further, because no lay-in yarn is used, it will not be necessary to raise the dial plate. The function of the finger 62 then is to exercise control over the formation of the stitches 46 which are stretched tight over the finger during their formation. This has two beneficial effects. First it helps to provide neatly formed stitches and second, it helps to prevent the stitches sliping off the cylinder and dial needles and building up a mass of spoiled stitches on those needles. This is particularly of advantage when a press-off occurs.

A slightly modified form of yarn guide 80 is shown in FIG. 7. This has a guide portion 82 and a finger 84, and the finger is similar to the finger 62 of the guide member previously described. However, the guide portion 82 takes the form of a scroll which at the entry end subtends more than 360°, but which is open at 86. Hence it is possible to pull the lay-in yarn into the guide portion 82 through the opening 86 and it is then highly unlikely that the yarn will unthread itself from that portion.

In the specific examples described above, only some of the dial needles 18 are operative. However, it is to be understood, that the invention could be used with the machine set up so that all the dial needles are operative. In that case, a complete row of rib stitches would be produced between each successive row of "ground" stitches, and the lay-in yarn would be trapped by all the rib stitches.

It is possible to construct the guide member so that the finger lies over the top of the lay-in yarn instead of alongside it.

I claim:

1. A circular knitting machine of the type having cylinder needles, dial needles and at least one yarn feeder and wherein the cylinder needles are lifted and the dial needles are projected as part of stitch forming operation, provided with a relatively stationary guide member comprising an axially extended mainly tubular eye portion having an inlet end located outside the angle between the verges of said cylinder needles and said dial needles and an outlet end located inside the angle between the verges of said cylinder needles and said dial needles, and a finger portion extending in the angle between the verges of said cylinder needles and said dial needles so that the cylinder needles may pass along the outer side of said guide member and the dial needles may pass above said guide member, said eye portion merging into said finger portion and said finger extending over at least the region where said cylinder needles begin to lift at the leading end of said yarn feeder.

2. A circular knitting machine according to claim 1, in which said finger of said guide member extends from a position in advance of that at which said cylinder needles begin to lift to the rear of the position at which said needles slip the loops, so that said finger is effective to control the stitches formed between said cylinder needles and said dial needles throughout the zone wherein said needles are lifted.

3. A circular knitting machine according to claim 1, in which said finger portion of said guide member is disposed behind said cylinder needles (when the latter are lifted) and below said dial needles (when the latter are advanced).

4. A circular knitting machine according to claim 1, comprising mounting means for said guide member, said mounting means providing for circumferential adjustment of said guide member on the machine.

5. A circular knitting machine as defined in claim 1, wherein said eye portion tapers in cross-section gradually between said inlet end and said outlet end, and said finger is long and relatively narrow and at least slightly concave on the side opposite the cylinder needles.

6. A method of knitting a fabric on a circular weft knitting machine of the type in which there are cylinder needles, dial needles and at least one yarn feeder, comprising the steps of: forming at least some yarn loops on said cylinder needles and at least some yarn loops on said dial needles to thereby create an open "mouth" between said loops on said cylinder and dial needles; feeding a lay-in yarn into said open "mouth"; containing said lay-in yarn in said open "mouth" by engaging said lay-in yarn with yarn guide means extending into said open "mouth" from the position at which said needles begin to lift to the position at which said needles slip the loops; forming stitches on said yarn guide means between said loops on said cylinder and dial needles which stitches with said guide means tightly embrace said lay-in yarn, and sliding said stitches off said yarn guide means.

* * * * *